US006350966B1

(12) United States Patent
Potthof et al.

(10) Patent No.: US 6,350,966 B1
(45) Date of Patent: Feb. 26, 2002

(54) ELECTRONIC COOKER TIME SWITCH

(75) Inventors: Erwin Potthof, Rotenbach; Walter Spitzl, Schwaig, both of (DE)

(73) Assignee: Diehl Controls Nümberg GmbH & Co. KG, Nurnberg (DE)

( * ) Notice: Subject to any disclaimer, the term of this patent is extended or adjusted under 35 U.S.C. 154(b) by 0 days.

(21) Appl. No.: 09/492,653

(22) Filed: Jan. 27, 2000

(30) Foreign Application Priority Data

Feb. 9, 1999 (DE) ..... 299 02 257

(51) Int. Cl.[7] ..... H05B 1/02

(52) U.S. Cl. ..... 219/492; 219/493; 219/508; 219/494; 219/719

(58) Field of Search ..... 219/497, 501, 219/719, 508, 720, 492, 493, 494; 307/117, 119

(56) References Cited

U.S. PATENT DOCUMENTS 4,409,662 A * 10/1983 Rao ..... 364/557
4,713,528 A * 12/1987 Hirata ..... 219/492
4,914,277 A * 4/1990 Guerin et al. ..... 219/506
5,398,597 A * 3/1995 Jones et al. ..... 99/330

FOREIGN PATENT DOCUMENTS

DE 33 20 128 C3 12/1984
GB 2205177 * 11/1988

* cited by examiner

*Primary Examiner*—Mark Paschall
(74) *Attorney, Agent, or Firm*—Scully, Scott, Murphy & Presser

(57) ABSTRACT

An electronic cooker time switch (1) having a display panel, input elements for time data and switching times, a control circuit, a relay for automatically switching an electric load on and off, and a change-over switching device for switching over from an automatic to a manual mode, wherein there are provided a display portion (2) which has a time switch with digital display and a circuit board (15) with mains unit and control electronics, and an operating portion (3) which is arranged separately from the display portion. This modular design unit that it is possible to use different kinds of operating portions (3) with one and the same display portion (2). The operating portion (3) and the control electronics on the circuit board (15) in the display portion (2) are electrically conductively connected together by way of a flat ribbon cable (4), while data transmission between the operating portion (3) and the control electronics is effected in encoded fashion so that different operating portions can be detected by the control electronics.

9 Claims, 1 Drawing Sheet

ELECTRONIC COOKER TIME SWITCH

BACKGROUND OF THE INVENTION

1. Field of the Invention

The innovation concerns an electronic cooker time switch having a display panel, input elements for time data and switching times, a control circuit, a relay for automatically switching an electric load on and off, and a change-over switching device for switching over from an automatic to a manual mode.

2. Discussion of the Prior Art

Electronic cooker time switches of that kind have long been known; thus for example reference may be made to the cooker time switch produced by the applicants, with the trademark name "Orbitron", which is described for example in DE 33 20 128 C3.

In the case of conventional electronic cooker time switches of the specified kind the display panel and the input elements are respectively arranged in a common module while it was only earlier that the power control system for the connected electric load or loads was disposed separately, in individual cases. The display panel is generally similar in time switches which are fitted in various types of cookers or by various cooker manufacturers. In contrast the wishes of the cooker manufacturers in terms of the design configuration of the input elements of time switches in different types of cookers vary markedly. With the conventional cooker time switches the module containing the input elements and the display panel now have to be re-designed and freshly produced as a respective unit, even if the display panel always remains the same. That represents an unnecessary construction and production complication and expenditure.

Therefore, taking the above-indicated state of the art as its basic starting point, the object of the present invention is to provide an electronic cooker time switches in which the construction and production complication and expenditure is markedly reduced with different configurations for the input elements.

SUMMARY OF THE INVENTION

In accordance with the innovation that object is attained in that, in an electronic cooker time switch of the specified kind, there are provided a display portion which has a time switch with digital display and a circuit board with mains unit and control electronics, and an operating portion which is arranged separately therefrom and which has input elements.

The separation of the display portion and the operating portion means that, when there are wishes for modification in the design of the input elements, only the operating portion has to be re-designed and produced afresh. The display portion which contains the time switch with digital display and the circuit board with mains unit and control electronics can remain unchanged and used for a large number of cooker time switches of different design configurations. That means that it can be produced in larger numbers and thus more rationally and less expensively.

A variety of different embodiments can be envisaged for the operating portion. In that way it is possible specifically to meet the wishes of the cooker manufacturers. Thus, it is possible to provide push buttons or rotary switches, the arrangement of which can be implemented as desired, for setting the functions of the time switch (for example short time, operating period, ending operation and automatic-manual change-over). The rotary switch is preferably a rotatable pulse generator.

In a preferred embodiment the display portion is such that the circuit board carrying the mains unit and the control electronics is arranged perpendicularly to the display in the time switch, wherein connecting pins disposed on one longitudinal side of the display engage into bores disposed on a longitudinal side of the circuit board and are there soldered to the conductor tracks of the circuit board.

The operating portion in turn is preferably connected by way of a flat ribbon cable to the control electronics on the circuit board in the display portion, with data transmission between the operating portion and the control electronics being effected in encoded form. In that way various operating portions can be detected by the control electronics and used together with same.

This modular structure means that the number of printed circuit boards or complete display portions produced can be markedly increased whereby production is made more rational and more advantageous. In regard to the operating portions, there is no need for equipping them with electrical or electronic components and soldering thereof. That means that they are simple to produce and can be quickly and advantageously adapted to varying design wishes.

BRIEF DESCRIPTION OF THE DRAWINGS

Various embodiments of the invention are described in greater detail with reference to the drawing in which.

DETAILED DESCRIPTION OF PREFERRED EMBODIMENTS

Figure 1:
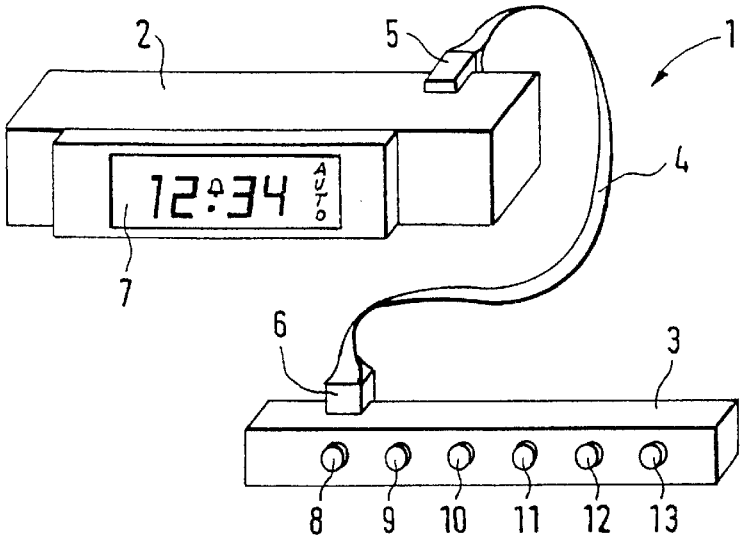
FIG. 1 shows an embodiment of the innovation with the display portion and the operating portion, connected by a flat ribbon cable.

The cooker time switch 1 comprises a display portion 2 and an operating portion 3 which is separate therefrom. The display portion and the operating portion are connected together by an electrical flat ribbon cable 4 which at its two ends has plugs 5 and 6 which can be plugged into the display portion and the operating portion, at locations which are provided for that purpose. Besides the digital display 7 the display portion 2 also has the actual time switch and a circuit board with mains unit and control electronics (not shown in FIG. 1). The operating portion 3 has six push buttons 8 to 13 arranged in a row one beside the other for setting the functions short time (8), operating period (9), end of operation (10) and automatic-manual change-over (11) and for increasing (12) and reducing (13) the values for the settable functions.

In another embodiment of the operating portion 3 (see FIG. 2) the buttons 8 to 13 are arranged in a line which is curved on one side. In yet another embodiment of the operating portion 3 (FIG. 3), there are provided four buttons 8 to 11 for setting the functions short time (8), operating time (9), end of operation (10) and automatic-manual change-over (11) together with a rotary switch (14) for setting the values for the settable functions. The four buttons 8 to 11 on the operating portion 3 are arranged around the rotary switch 14, enclosing it from all sides. The rotary switch used is preferably a rotatable pulse generator.

Figure 4:
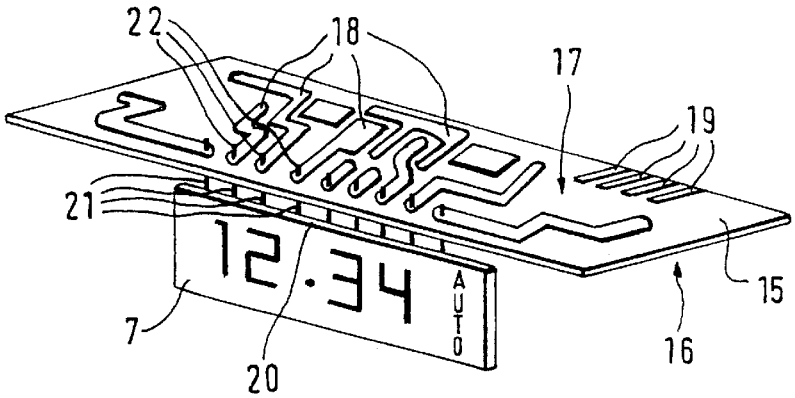
FIG. 4 shows the time switch display and the circuit board which is arranged perpendicularly thereto and which carries the mains unit and the control electronics.

The digital display 7 in the display portion 2 of the cooker time switch 1 is preferably arranged perpendicularly to the circuit board 15 (see FIG. 4). The circuit board 15 is provided on its underside 16 with the components of the actual time switch, the mains unit and the control electronics (not visible in FIG. 4). Disposed on the top side 17 of the circuit board 15 are conductor tracks 18 which electrically interconnect and link together inter alia the components disposed on the underside 16. Also disposed on the top side 17 of the circuit board 15 are contact strips 19 onto which is fitted the plug 5 of the flat ribbon cable 4.

Disposed on the upper longitudinal side 20 of the digital display 7 are a plurality of connecting pins 21 which can be plugged through corresponding bores 22 in the circuit board 5 and are there soldered to the conductor tracks 18. This direct connection of the digital display 7 to the circuit board 15 reduces the wiring complication and expenditure and the amount of space required by the time switch. The components disposed on the underside 16 of the circuit board 15 are disposed "behind," the digital display 7, in such a way as to save space.

Figure 2:
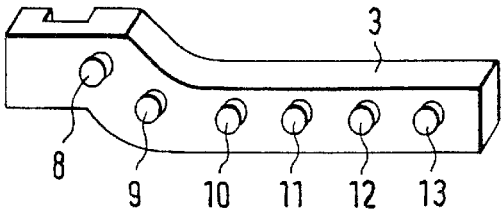
FIG. 2 shows a further embodiment of the operation portion.
Figure 3:
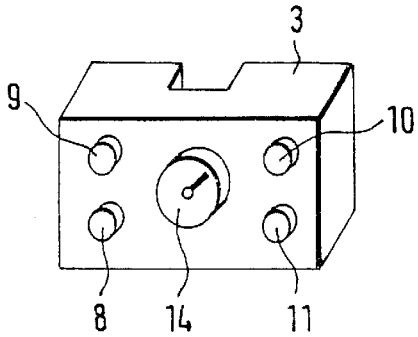
FIG. 3 shows still another embodiment of the operating portion.

The electrical connection between the display portion and the operating portion 3 by way of the multi-wire flat ribbon cable 4 is effected in encoded fashion. Depending on whether an operating portion with six buttons (as shown in FIG. 1 or FIG. 2) or an operating portion with four buttons and rotary switch (as shown in FIG. 3) is used, the various wires are occupied in different ways. Thus the control electronics in the display unit 2 "detects" which operating portion 3 is connected, and can correctly evaluate the signals thereof. This means that it is possible to use different operating portions and even types of operating portions together with one and the same display portion.

What is claimed is:

1. An electronic cooker timer arrangement comprising:

a first module having a display panel (2) including a display portion (7) providing a time switch with a digital; a control circuit; and a circuit board (15) mounted on said panel with a mains unit and control electronics connected to said control circuit;

a second module detachably connected to said first module said second module including an operating portion (3) comprising operating elements controlling a relay for automatically switching an electrical load on and off; a change-over switching device for switching between automatic and manual operating modes, said input elements providing time, date and switching times, and connecting structure for operatively and detachably interconnecting said first and second modules.

2. An electronic cooker timer arrangement as claimed in claim 1, wherein the input elements of said operating portion (3) comprise buttons (8, 9, 10, 11, 12, 13) for selectively setting functions consisting of short time, operating period, end of operation and automatic-manual change-over, increasing and reducing the values for short time operating period, end of operation and clock time.

3. An electronic cooker timer arrangement as claimed in claim 2, wherein six said buttons (8, 9, 10, 11, 12, 13) are located on said operating portion (3) arranged in a row in a mutually juxtaposed relationship.

4. An electronic cooker timer arrangement as claimed in claim 2, wherein said buttons (8, 9, 10, 11, 12, 13) are located on said operating portion (3) in an at least partially curvilinear arrangement.

5. An electronic cooker timer arrangement as claimed in claim 1, wherein said input elements of the operating portion (3) comprise four buttons (8, 9, 10, 11) for selectively setting the functions consisting of short time, operating period, end of operation and automatic-manual change-over, and a rotary switch (14) for setting the values for short time, operating period, end of operation and clock time.

6. An electronic cooker timer arrangement as claimed in claim 5, wherein said rotary switch (14) comprises a rotatable pulse generator.

7. An electronic cooker timer arrangement as claimed in claim 5 or 6, wherein said four buttons (8, 9, 10, 11) are arranged spaced about the operating portion (3) so as to encompass the rotary switch (14).

8. An electronic cooker times arrangement as claimed in claim 1, wherein the circuit board (15) carrying the mains unit and the control electronics is arranged on said first module display panel (2) perpendicularly to the display (7); connecting pins (21) being disposed on one longitudinal side (20) of the display panel (2) engaging into bores (22) formed in one longitudinal side of the circuit board (15) and being soldered to conductor tracks (18) located on the circuit board (15).

9. An electronic cooker timer as claimed in claim 1, wherein said connecting structure for connecting the operating portion (3) of said second module comprises a flat ribbon cable (4) connected to the control electronics on the circuit board (15) of said first module, whereby data transmission between the operating portion (3) and the control electronics is effected in an encoded mode such that different operating portions (3) can be detected by the control electronics and operated in conjunction therewith.

* * * * *